United States Patent [19]

Karlsson et al.

[11] Patent Number: 4,547,908

[45] Date of Patent: Oct. 22, 1985

[54] CAP ARRANGEMENT

[76] Inventors: Peter Karlsson, Kyrkogatan 38 B, S-570 22 Forserum; Leif Palmaer, Kristinagatan 14, S-331 00 Värnamo, both of Sweden

[21] Appl. No.: 486,373

[22] Filed: Apr. 19, 1983

[30] Foreign Application Priority Data

May 3, 1982 [SE] Sweden ..... 8202747

[51] Int. Cl.[4] ..... A42B 3/00

[52] U.S. Cl. ..... 2/424; 2/10

[58] Field of Search ..... 2/424, 10, 5, 6, 8, 2/9, 10, 4, 410, 423

[56] References Cited

U.S. PATENT DOCUMENTS

| | | | |
|---|---|---|---|
| 1,075,906 | 10/1913 | Duncan et al. | 2/424 X |
| 3,026,525 | 3/1962 | Gyorfy | 2/8 |
| 3,380,073 | 4/1968 | McLaughlin | 2/10 X |
| 3,582,989 | 6/1971 | Fassbender | 2/4 |
| 4,017,906 | 4/1977 | Bochynsky et al. | 2/10 |
| 4,121,303 | 10/1978 | Reece | 2/10 X |
| 4,184,212 | 1/1980 | Bowman | 2/5 |
| 4,224,694 | 9/1980 | Palmaer | 2/424 X |

FOREIGN PATENT DOCUMENTS

| | | | |
|---|---|---|---|
| 1527271 | 4/1968 | France | 2/10 |

*Primary Examiner*—Peter Nerbun

*Attorney, Agent, or Firm*—Ostrolenk, Faber, Gerb & Soffen

[57] ABSTRACT

A cap arrangement is disclosed for sealing the space between the outer surface of a protective helmet and the upper edge of a pivotally mounted visor carried by the helmet, to prevent, for example, sawdust passing to the space on the inside of the visor during timber sawing operations. The cap arrangement comprises a sheet of fabric having a front edge secured to the upper edge of the visor and a rear edge secured to an elastic ribbon attached at its ends to the mountings which pivotally support the visor at the sides of the helmet.

4 Claims, 2 Drawing Figures

CAP ARRANGEMENT

DESCRIPTION OF INVENTION

The present invention relates to a cap arrangement intended to seal the space between a protective helmet, and a shield or visor, carried by the helmet. The invention also relates to the combination of such a cap arrangement with a helmet and shield or visor.

The term helmet, as used herein, is intended to extend to any form of protective headgear, irrespective of the nature of the protection afforded.

BACKGROUND OF THE INVENTION

The use of protective helmets by workers in manual timber-cutting is nowadays compulsory for safety. The helmets used in this connection are provided with hinged face shields or visors. A serious problem, which has attracted attention for a long time in connection with such helmets provided with visors in this field, is that saw-dust can get between the helmet and the visor and thus be inhaled or cause serious damage to the eyes of the wearer. Attempts have been made previously to design such a hinged visor so that it in the lowered position can be displaced backwards to sealing engagement with the front edge of the respective helmet. This design requires a fairly complicated mechanism, where the visor is required to be capable of being raised pivotally relative to the helmet as well as being displaceable backwards, which mechanism is thus also somewhat sensitive to disturbances. Furthermore, with the designs previously adopted, in the lowermost sealing position the visor is undesirably close to the wearer's face. Moreover, this solution does not materially eliminate the problem, because even if the entry of dust or the like is prevented when the visor is lowered, it is still possible for dust or other foreign matter to fall down over the face inside the visor, when the visor is raised, for it is not possible to eliminate the risk that saw-dust, conifer needles, twigs, snow, etc. may settle against the upper edge of the visor when this is in its lowered position and is in contact with the front edge section of the helmet.

In another arrangement, proposed in U.S. Pat. No. 3,727,235 a narrow beading of rubber, plastic or similar material, is permanently attached to the upper edge of the visor and is angled in towards the helmet and scrapes against this when the visor is being swung upwards to its raised position. Neither can this proposal give perfectly satisfactory sealing, and furthermore this sealing arrangement requires a rather specialized displaceable frictional attachment of the visor to the helmet. This arrangment cannot be satisfactorily adopted where the visor is merely arranged to be raised and lowered by swivelling around simple pivotal attachments in the helmet.

SUMMARY OF THE INVENTION

It is an object of the present invention to provide a cap arrangement which completely avoids the above described problems.

According to one aspect of the invention there is provided a cap arrangement suitable for sealing the space between a protective helmet and a visor, carried by the helmet, the cap arrangement consisting of a sheet of flexible material, having a front edge for attachment to an upper edge of such a visor and adapted to extend from such upper edge to the helmet, and the cap arrangement having a rear edge adapted to make sealing contact with the outer surface of such a helmet when the portions of such cap arrangement at the ends of said rear edge are attached to respective opposite sides of the helmet.

According to another aspect of the invention there is provided the combination of such a cap arrangement with a helmet and a shield or visor pivotally connected with the helmet and having an upper and a lower edge, the cap arrangement having said front edge attached to the upper edge of the shield or visor and extending from said upper edge of the shield or visor to said rear edge, which makes sealing engagement with the outer surface of said helmet, portions of the cap arrangement at the ends of said rear edge being attached to respective opposite sides of the helmet.

Due to the fact that the cap arrangement consists of a sheet of flexible material, the front edge of which is attached to the upper edge of the visor or the protective shield and extends from this to the helmet for sealing engagement with this, the sealing effect of the cap arrangement is maintained whether the shield or visor is raised or lowered.

The flexible sheet material of the cap arrangement preferably consists of a water-repellant or waterproof material for example a water-repellant or waterproof textile material, but can also consist of an air and water permeable fabric such as flexible net or the like.

When the cap arrangement is used in connection with a protective helmet for wear by workmen engaged in welding or grinding, a fire-retardant material is preferably used for the cap arrangement.

By arranging an elastic ribbon at the rear edge of the cap arrangement, with the ends of the ribbon being attached to respective sides of the helmet, it is possible to ensure, in a simple way, that said rear edge is held firmly against the outer surface of the helmet. An elastic ribbon can advantageously be arranged also at the front edge of the cap arrangement, which provides the possibility of using a simple detachable attachment of the cap arrangement to the upper edge of the visor. The elastic ribbons are in this connection preferably sewn, in a stretched out state, to the cap arrangement, with the arrangement being such that when fitted to the helmet, the flexible sheet material will be substantially fully extended along said edges, against the protective visor and against the headgear, respectively, in the working position, with the elastic ribbons being appropriately tensioned.

An embodiment of the invention is described below by way of example with reference to the accompanying drawings.

DESCRIPTION OF EMBODIMENT OF INVENTION

Figure 1:
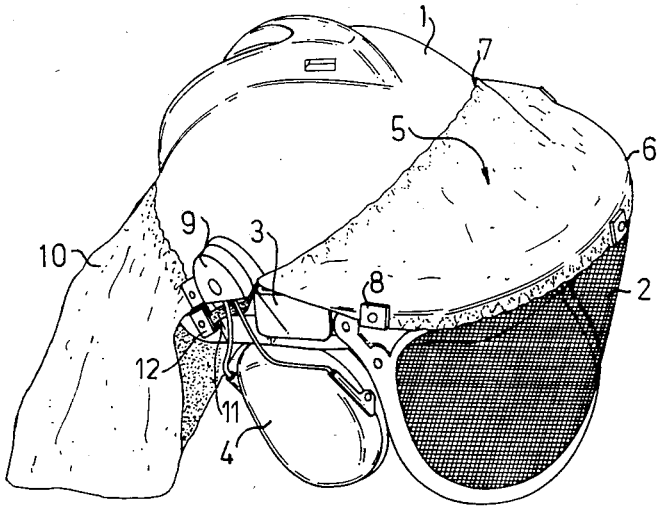
FIG. 1 is a perspective view of a protective helmet with a visor, provided with a cap arrangement embodying the invention, with the visor being shown in a lowered position.
Figure 2:
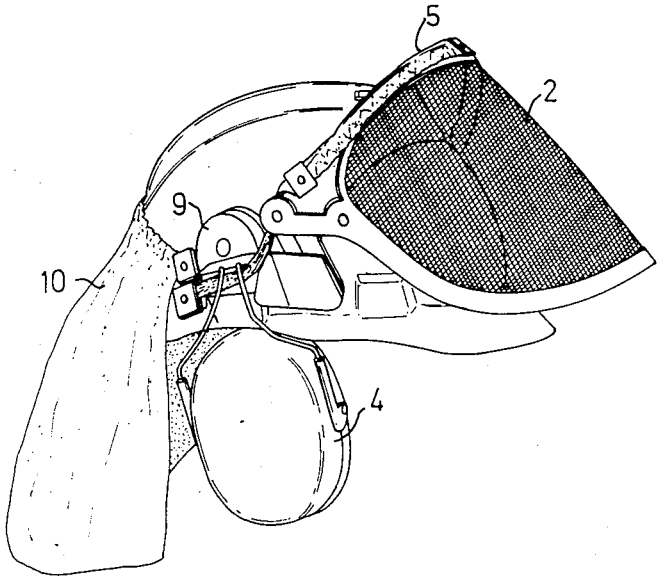
FIG. 2 is a perspective view of the protective helmet, visor and cap arrangement of FIG. 1 but with the visor in a raised position.

The helmet 1 shown in FIG. 1, which is of the type having a rigid shell affording the outer surface of the helmet, carries a visor 2 which is connected with the helmet by a hinge mechanism 3 so that the visor can be swung between a stable lowered position shown in FIG. 1 and a stable raised position shown in FIG. 2. The helmet 1 is also provided with ear protectors 4 intended to protect the hearing of the wearer from excessive noise, and a protective flap 10 for the nape of the wearer's neck. A cap arrangement generally designated 5 extends between the visor 2 and the helmet and consists in this case of a sheet of water-repellant textile fabric. The front edge 6 of the cap arrangement 5 is attached to the upper edge of the visor 2 by means of attachments 8, each consisting of a clamp provided with a pin, holding the front edge 6 of the cap arrangement. The rear edge 7 of the cap arrangement 5 fits against the outer surface of the helmet, in the upper front region of the helmet, and is provided with an elastic ribbon, the ends of which are attached to the sides of the helmet 1, or, as shown in FIG. 1, are attached to attachments 12 located below mounting members 9 carrying the ear protectors 4 and the hinge mechanism 3 for the visor 2.

By attaching both ends of the elastic ribbon fitted to the rear edge of the cap arrangement far to the rear at the sides of the helmet 1, the advantage is afforded that the cap arrangement 5 always tends to be drawn towards a stretched state, because the elastic ribbon at the rear edge of the cap arrangement 5 tends to pull the cap arrangement rearwards and upwards along the shell of the helmet.

In FIG. 2 the visor 2 is shown in a raised position. The movement of the visor to the raised position is not in the least prevented by the cap arrangement 5. The protective flap 10 for the nape of the neck also comprises a flexible sheet of textile material also provided along its upper edge with an elastic ribbon which keeps the flap 10 in its intended position with respect to the shell of the helmet. The elastic ribbon extended along the upper edge of the flap 10 may be the same ribbon which extends along the rear edge of the cap arrangement, said ribbon extending in a continuous closed loop part of which carries the cap arrangement and part of which carries the flap 10, with exposed portions of said loop, extending between the flap 10 and cap arrangement, passing under the attachment points for the ear protectors 4 to hold the flap 10 and cap arrangement onto the helmet.

The invention has been described with respect to a specific embodiment, but is not to be limited to this, because it is evident that one of skill in the art, with the present specification before him, will be able to make various modifications within the scope of the invention. For example, the central portion of or the whole length of the rear edge of the cap arrangement, and not only the portions at the end of said edge, can be more or less permanently attached to the shell of the helmet. In this and other modifications the rear edge of the cap will remain in fixed position along the shell of the helmet also when the visor is raised, the central portion of the cap then being partly folded down between the upper edge of the visor and the helmet.

I claim:

1. A cap arrangement suitable for sealing the space between a protective helmet and a visor pivotally mounted on said helmet, said visor having an upper edge and a lower edge, the cap arrangement consisting of a sheet of flexible material having a front edge for attachment to said upper edge of said visor, a rear edge for making sealing contact with the outer surface of such a helmet, attachment means for attaching said cap arrangement to respective opposite sides of the helmet, said attaching means including a flexible ribbon, means attaching said ribbon to said rear edge of the cap arrangement, and means for connecting ends of said ribbon which extends beyond the sheet of flexible material to respective opposite sides of said helmet.

2. A cap arrangement suitable for sealing the space between a protective helmet and a visor pivotally mounted on said helmet, said visor having an upper edge and a lower edge, the cap arrangement consisting of a sheet of flexible material having a front edge for attachment to said upper edge of said visor, a rear edge for making sealing contact with the outer surface of such a helmet, said rear edge having ends, the cap arrangement having portions at said rear ends and attachment means, including a flexible ribbon, for attaching the portions of the cap arrangement at the ends of said rear edge to respective opposite sides of the helmet, including a flexible ribbon and means securing said ribbon to said front edge of the cap arrangement.

3. A cap arrangement according to claim 1 in which said ribbon is elastic and is attached by sewing, in a stretched out state, to said sheet of flexible material, to make possible a tight engagement of said rear edge of the cap arrangement with the helmet.

4. A cap arrangement according to claim 2 in which said elastic ribbon is attached by sewing, in a stretched out state, to said sheet of flexible material, to make possible a tight engagement of said front edge of the cap arrangement with the upper edge of the visor.

* * * * *